United States Patent [19]

Kramer

[11] Patent Number: 4,913,194

[45] Date of Patent: Apr. 3, 1990

[54] LIGHT WEIGHT HEDDLE FRAME ASSEMBLY SLAT

[75] Inventor: Charles F. Kramer, Greenville, S.C.

[73] Assignee: Steel Heddle Mfg. Co., Greenville, S.C.

[21] Appl. No.: 273,276

[22] Filed: Nov. 18, 1988

[51] Int. Cl.[4] ..... D03C 9/04

[52] U.S. Cl. ..... 139/91

[58] Field of Search ..... 139/91, 92

[56] References Cited

U.S. PATENT DOCUMENTS

| | | | |
|---|---|---|---|
| 3,754,577 | 8/1973 | Heller | 139/92 |
| 3,901,282 | 8/1975 | Kramer et al. | 139/92 |
| 4,355,667 | 10/1982 | Shimizu | 139/91 |
| 4,790,357 | 12/1988 | Kramer | 139/91 |

*Primary Examiner*—Henry S. Jaudon

*Attorney, Agent, or Firm*—Dority & Manning

[57] ABSTRACT

A lightweight frame slat for use in a heddle frame assembly. Each of said slats comprises an upper hollow portion and a heddle bar support portion integral with and extending from the hollow elongated portion. The hollow portion is made up of a vertically extending back portion and a vertical front portion so that when the front portion is in place three longitudinal cavities are formed. Adjacent each of the edge of the hollow elongated upper portion is disposed elongated stiffening bars of a carbon fiber reinforced stiffening element. The intermediate cavity between the edge cavities is filled with a strip of ridged foam to add structural stability to the slat without greatly increasing its weight.

Extending from, and integral with the back portion of the slat is a heddle bar support portion which has extending from it near its bottom edge two horizontal ledges which define a heddle bar support channel. Each of the ledges has on their adjacent surfaces a longitudinally extending ridge for locking the support rib of a heddle bar in place with an interference fit. Each of the locking ridges taper inwardly of the channel towards the bottom thereof to permit easy entry of the supporting rib of the heddle bar while restricting its withdrawal therefrom without preventing its removal from the slat.

14 Claims, 2 Drawing Sheets

LIGHT WEIGHT HEDDLE FRAME ASSEMBLY SLAT

BACKGROUND OF THE INVENTION

The invention relates to a light weight reinforced heddle frame slat for use in a heddle frame assembly on a loom. The heddle frame slat of the invention is utilized in the construction of a heddle frame assembly on a loom to support the heddle rods. The heddle frame include a top frame slat and a bottom frame slat, which are spaced apart in the frame by a pair of side frame members. Individual heddles are slidably carried on heddle bars which are supported by the slats in the heddle frame assembly. The heddles include eyes through which warp ends are threaded.

In the loom, the heddle frame raises and lowers the warp ends to create a shed through which the warp yarn is inserted during weaving. In lifting the warp threads during the shedding motion, the heddle frame undergoes forces in a vertical direction while moving the warp ends to form the shed. This produces a bending motion on the frame slat and also on the heddle rod.

As the speeds at which the looms are driven increases, the inertia loading on the heddle frames during shedding is greatly increased. Since the inertia forces are dependent upon the mass of the heddle frame assembly, there has been a great need to provide light weight frame structures for the heddle frame assembly without sacrificing structural integrity. During the shedding motion, the heddle frames assembly reciprocates vertically in rapid strokes which increase as the operating speeds of the looms increase. Therefore, the provision of a light weight component for the heddle frame assembly is a problem to which considerable attention need be given.

Considerable progress has been made in this area as is represented by the disclosure in U.S. Pat. No. 4,633,916 issued Jan. 6, 1987 to John L. Rast, commonly owned by the assignee of the instant application. This patent discloses a light weight shear-resistant frame slat with means for supporting a heddle rod or bar at one edge of a reduced neck portion. In the slat of this patent, two ledges form a mounting slot for the heddle bar or rod. The heddle bar disclosed in this patent is preferably a carbon fiber pultrusion which is affixed in the mounting slot by means of an epoxy glue or the like.

Since the heddle bar is bonded in the supporting slot of the slat of U.S. Pat. No. 4,633,916 it is very difficult to replace the heddle bar whenever it becomes damaged or worn.

SUMMARY OF THE INVENTION

Accordingly, an important object of the present invention is to provide a heddle frame assembly slat which is light weight and in which the heddle bar is readily replaceable.

Still another important object of the invention is to provide a frame slat for a heddle frame assembly is which the heddle bar is held securely in the slat while permitting its removal therefrom.

Still another important object of the invention is to provide a frame slat for a heddle frame assembly which includes a uniquely formed mounting slot along the length of the heddle frame slat for permitting the heddle bar to be removably supported by the slot.

The above objects are accomplished according to the present invention by providing a frame slat which is fabricated from extruded aluminum parts to form a hollow elongated slat having three cavities within the slat. The upper and lower cavities in the slat contain a pultruded carbon fiber bar for reinforcing the edges of the slat. The intermediate cavity is filled with a light weight foam or the like for adding stability without greatly increasing the weight of the slat. The slat includes a back portion and a front portion which are bonded together to form the slat and the cavities. The cavities are filled with the reinforcing bars or the reinforcing strip of foam prior to the assembly of the slat.

Each of the slats is provided with a heddle bar support extension portion which is integral with the back portion and extends from the back portion in a generally vertical plane and contains a heddle bar support channel which is defined by spaced upper and lower ledges which extend from the heddle bar support portion in generally horizontal planes. Each of the ledges have a locking ridge disposed on their adjacent surfaces for gripping and holding the mounting rib of a heddle bar. The dimensions of the heddle bar rib and the heddle bar support channel are selected so as to provide for an interference fit between the inner walls of the channel and the outer walls of the heddle bar rib. This permits the heddle bar to be readily attached to the slat in which it is held securely during use by the locking ridges of the channel. The ridges on the walls of the channel makes it difficult to remove the heddle bar but still permits its removal whenever necessary. This prevents its accidental removal from the channel during use of the frame assembly on the loom.

BRIEF DESCRIPTION OF THE DRAWINGS

The construction designed to carry out the invention will be hereinafter described, together with others features thereof the invention will be more readily understood from a reading of the following specification, and by reference to the accompanying drawings, forming a part thereof, wherein an example of the invention is shown and wherein.

DETAILED DESCRIPTION OF THE DRAWINGS

Figure 1:
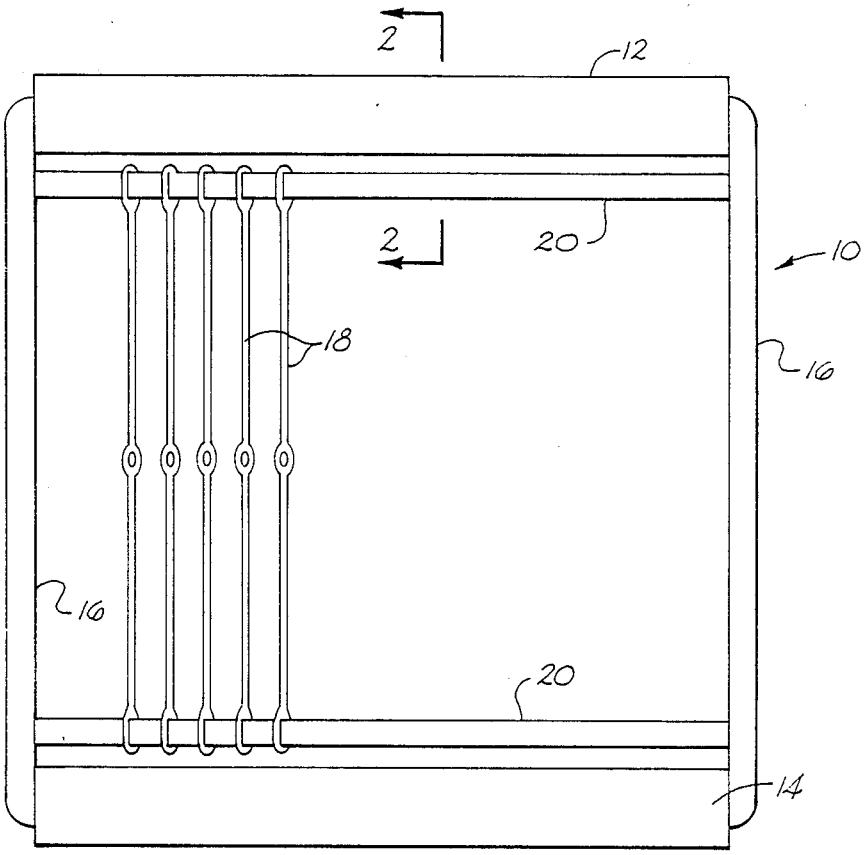
FIG. 1 is an elevational front view illustrating the heddle frame assembly for a loom, having frame slats constructed in accordance with the present invention.
Figure 5:
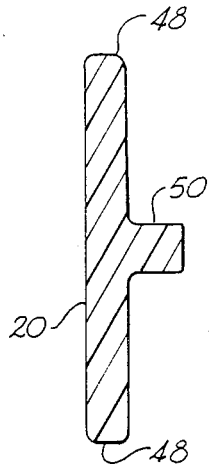
FIG. 5 is a cross-sectional view of a heddle bar used in the invention.
Figure 4:
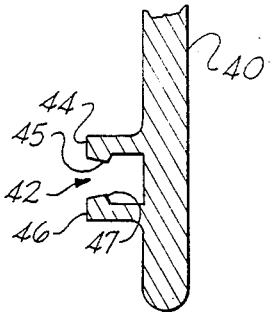
FIG. 4 is an enlarged cross-sectional view of the heddle bar support channel of the invention.
Figure 2:
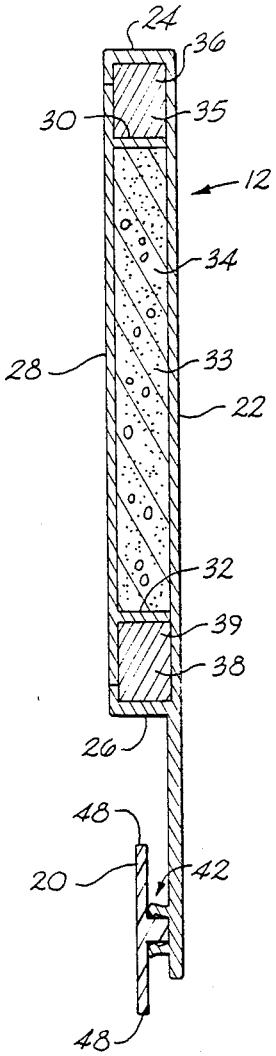
FIG. 2 is a sectional view taken along line 2—2 of FIG. 1.
Figure 3:
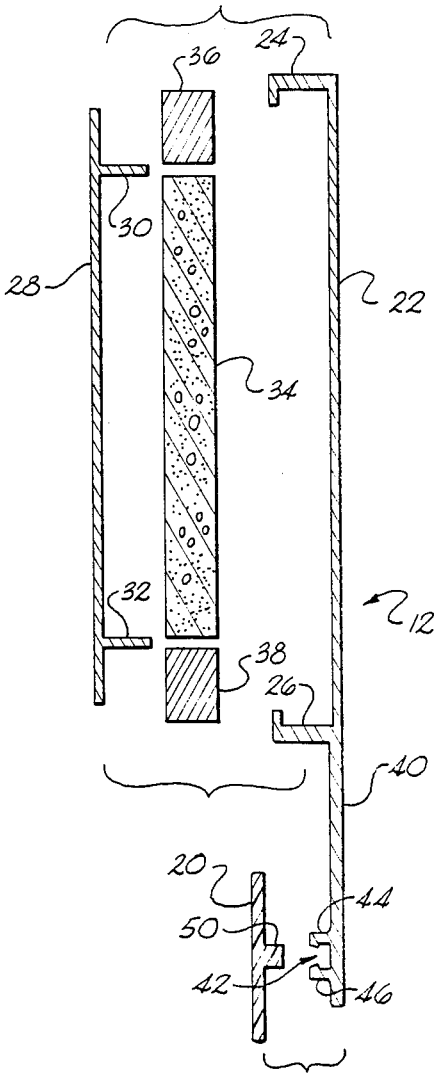
FIG. 3 is an exploded sectional view similar to FIG. 2, showing each part of the slat of the invention.

The invention relates to a vertically reciprocated heddle frame assembly for use on a loom where it holds the warp end, and raises and lowers the warp ends during the shedding. Since the structural and operational features of the looms are well known the loom will not be illustrated and only so much of the heddle frame assembly as is necessary for an understanding of the present invention is shown in the drawings.

Referring now to FIG. 1 of the drawings, wherein is illustrated the heddle frame assembly of the invention. Heddle frame assembly 10 comprises a top slat 12 and a bottom slat 14, which are supported horizontally by side frame members 16 in parallel relationship to each other. Each of the slats comprises a heddle supports bar 20 for supporting a plurality of heddles 18.

Referring now to FIGS. 2, 3, 4, and 5 of the drawings, wherein slat 12 is illustrated in detail. Slat 12, and also slat 14, comprises a back plate 22 which extends generally in a vertical plane. At the top of back plate 22 is a cap 24 which extends generally horizontally and is integral with the back plate 22. Spaced from cap 24, in an intermediate portion of the back plate 22, is a bottom portion 26 which is integral with back plate 22, and which projects therefrom in a generally horizontal plane. The hollow portion of slat 12 is completed by mating slat front portion 28, which extends in a vertical plane which is generally parallel to the vertical plane of back plate 22. Slat front 28 has a top spacer 30 and a bottom spacer 32, integral therewith but extending therefrom at a generally right angle in a horizontal plane. The length of spacers 30 and 32 is the same as the length of cap 24 and bottom 26 to form a series of spaced cavities 33, 35, and 37. Cavities 35 and 37, respectively, are located adjacent to the top and the bottom edges of the hollow portion of the slat. Cavities 35 and 37 are separated by an intermediate cavity 33.

In cavities 35 and 37, respectively, are located reinforcing bars 36 and 38. These bars may be pultruded carbon fiber bars which lend strength to the slat without greatly increasing the weight thereof. Reinforcing bars 36 and 38, and foam strip 34, can be pre-formed and placed into the proper position prior to the assembly of the frame slat. After these elements are in place against the back portion 22, front portion 28 may be placed in its final position with spacers 30 and 32 separating the reinforcing bars from the foam material in the center cavity. The front portion 28 and spacers 30 and 32 are bonded to the back portion 22 by an appropriate bonding material such as epoxy or the like.

At the lower end of the slat 12 in a heddle bar support portion 40 which is integral with, and an extension of, back plate 22. At the lower end of the heddle bar support portion 42 is a hooked heddle bar support channel 42, which is defined by an upper ledge 44 and a lower ledge 46 which extend transversely of the heddle bar support portion 40 in a generally horizontal plane. Upper ledge 44 has an upper locking ridge 45 on its lower surface and lower ledge 46 has a lower locking ridge 47 on its upper surface or its surface which is closest to the upper ledge 44. Supported within support channel 42 is a heddle bar 20 which is generally T-shaped in cross-section and has heddle supporting surfaces 48 with an intermediate heddle bar mounting rib 50, which extends into channel 42. The dimensions of channel 42 and the heddle bar mounting rib 50 are selected so as to provide an interference fit between the heddle bar mounting rib 50 and the inner walls of the upper and lower ledges, defining the heddle bar support channel 42. Upper and lower locking ridges 45 and 47 readily admits the entry of the heddle bar mounting rib 50 but makes removal therefrom difficult but not impossible. This feature is important since it permits the disassembly of the heddle bar from the slat whenever the heddle bar becomes worn or damaged during usage.

Heddle bar 20 may be the heddle bar disclosed in U.S. Pat. No. 4,633,916 or the heddle bar disclosed in the application filed with this application in the name of Gene Faasse and assigned to the owner of this application.

What is claimed is:

1. In a heddle frame assembly for a loom, having upper and lower frame slats, vertically spaced from each other by side members to form a generally rectangular frame, wherein each of said slats comprises:

(a) a hollow elongated upper portion having a plurality of cavities therein extending longitudinally of said slat;

(b) a heddle bar support portion, integral with, and extending from said hollow elongated upper portion and extending along the entire length of said heddle frame assembly;

(c) a heddle bar support channel defined by spaced upper and lower ledges, each of which are integral with, and extend from said heddle bar support portion in a generally horizontal plane, each of said ledges having locking ridges disposed on their adjacent surface for gripping and holding a heddle bar rib; and (d) a heddle bar having surfaces for supporting heddles and a supporting rib having a thickness for engaging the adjacent surfaces of said upper and lower ledges in an interference fit with said locking ridges to releasably retain and support said heddle bar while permitting the replacement of said heddle bar.

2. The frame slat as set forth in claim 1, wherein said locking ridges extend longitudinally of said slat from one end thereof to the other.

3. The frame slat as set forth in claim 2, wherein said ridges taper inwardly of said support channel towards the bottom thereof.

4. In a heddle frame assembly for a loom, having upper and lower frame slats, vertically spaced from each other by side members to form a generally rectangular frame, wherein each of said slats comprises:

(a) a hollow elongated upper portion having a plurality of cavities therein extending longitudinally of said slat, at least one of which has stiffening means disposed therein extending from one end of said slat to the other end thereof;

(b) a heddle bar support portion, integral with, and extending from said hollow elongated portion;

(c) a heddle bar support channel defined by spaced upper and lower ledges, each of which are integral with, and extend from said heddle bar support portion in a generally horizontal plane, each of said ledges having locking ridges disposed on their adjacent surfaces for gripping and holding a heddle bar rib; and (d) a heddle bar having surfaces for supporting heddles and a supporting rig having a thickness for engaging the adjacent surfaces of said upper and lower ledges in an interference fit with said locking ridges to releasably retain and support said heddle bar while permitting the replacement of said heddle bar.

5. The frame slat as set forth in claim 4, wherein stiffening means is provided in said cavities adjacent the edges of said hollow elongated upper portion.

6. The frame slat as set forth in claim 5 wherein at least one of said cavities is filled with a rigid light weight foam material.

7. In a heddle frame assembly for a loom, having upper and lower frame slats, vertically spaced from each other by side frame members to form a generally rectangular frame, wherein each of said slats comprises:

(a) a back portion extending in a generally vertical plane;

(b) a cap portion, integral with, and extending from said back portion in a generally horizontal plane;

(c) a bottom portion, integral with, and extending from said back portion in a generally horizontal plane which is substantially parallel to said cap portion;

(d) a front portion extending in a generally vertical plane which is parallel to the plane of said back portion;

(e) upper and lower spacers, integral with, and extending from said front portion towards said back portion in a generally horizontal plane for a distance substantially equal to the length of said cap and bottom portions of said back portion, said spacers being spaced from said cap and said bottom portions and from each other, to form top and bottom elongated cavities and an intermediate elongated cavity;

(f) a heddle bar support portion, integral with said back portion and extending therefrom in a generally vertical plane;

(g) a heddle bar support channel extending along the entire length of said heddle frame assembly, defined by spaced upper and lower ledges, each of which extend from said heddle bar support portion in a generally horizontal plane, each of said ledges having locking ridges disposed on their adjacent surfaces for gripping and holding a heddle bar supporting rib; and (h) a heddle bar extending along the entire length of said frame assembly, having surfaces for supporting heddles and a supporting rib which has a thickness for engaging the adjacent surfaces of said upper and lower ledges in an interference fit with said locking ridges to releasably retain and to support said heddle bar.

8. The frame slat as set forth in claim 7, wherein said intermediate cavity is filled with an elongated rigid foam strip.

9. The frame slat as set forth in claim 7, wherein said locking ridges extend longitudinally of said ledges from one end to the other thereof.

10. The frame slat as set forth in claim 9, wherein each of said ridges taper inwardly of said heddle bar support channel towards the bottom of said channel.

11. In a heddle frame assembly for a loom, having upper and lower frame slats, vertically spaced from each other by side frame members to form a generally rectangular frame, wherein each of said slats comprises:

(a) a back portion extending in a generally vertical plane;

(b) a cap portion, integral with, and extending from said back portion in a generally horizontal plane;

(c) a bottom portion, integral with, and extending from said back portion in a generally horizontal plane which is substantially parallel to said cap portion;

(d) a front portion extending in a generally vertical plane which is parallel to the plane of said back portion;

(e) upper and lower spacers, integral with, and extending from said front portion towards said back portion in a generally horizontal plane for a distance substantially equal to the length of said cap and bottom portions of said back portion, said spacers being spaced from said cap and said bottom portions and from each other, to form top and bottom elongated cavities and an intermediate elongated cavity, at least one of which cavities has longitudinally extending stiffening means extending from one end of said slat to the other;

(f) a heddle bar support portion, integral with said back portion and extending therefrom in a generally vertical plane;

(g) a heddle bar support channel, defined by spaced upper and lower ledges, each of which extend from said heddle bar support portion in a generally horizontal plane, each of said ledges having locking ridges disposed on their adjacent surfaces for gripping and holding a heddle bar supporting rib; and (h) a heddle bar, having surfaces for supporting heddles and a supporting rib which has a thickness for engaging the adjacent surfaces of said upper and lower ledges in an interference fit with said locking ridges, to releasably retain and to support said heddle bar.

12. The frame slat as set forth in claim 11, wherein said top and bottom cavities has a longitudinally extending stiffening reinforcing bar extending from one end of said slat to the other.

13. The frame slat as set forth in claim 12, wherein said stiffening reinforcing means is a pultruded carbon fiber bar.

14. The frame slat as set forth in claim 12, wherein said intermediate cavity is filled with an elongated rigid foam strip.

* * * * *